United States Patent [19]

Erickson

[11] 3,948,350

[45] Apr. 6, 1976

[54] ACOUSTIC RESONANT CAVITY

[75] Inventor: Clifford W. Erickson, Minnetonka, Minn.

[73] Assignee: Honeywell Inc., Minneapolis, Minn.

[22] Filed: Dec. 20, 1974

[21] Appl. No.: 534,995

[52] U.S. Cl. ..... 181/175; 73/69; 331/94.5 C; 333/83 R; 340/258 B

[51] Int. Cl.[2] ..... G10K 11/00

[58] Field of Search..... 181/175, 176; 333/83 R, 333/72, 71, 30 R, 76; 310/8; 73/24, 554, 559, 67.5 R, 69; 340/258 B; 331/94.5 C

[56] References Cited

UNITED STATES PATENTS

| | | | |
|---|---|---|---|
| 965,326 | 7/1910 | Prescott | 181/176 |
| 2,957,957 | 10/1960 | Johnson | 181/160 |
| 3,471,811 | 10/1969 | Klotz | 310/8 |
| 3,854,327 | 12/1974 | Felix | 73/69 |

*Primary Examiner*—Stephen J. Tomsky
*Attorney, Agent, or Firm*—David R. Fairbairn

[57] ABSTRACT

Resonant acoustic beams modes are generated by an acoustic energy source and a plurality of reflectors disposed along a path.

13 Claims, 10 Drawing Figures

ACOUSTIC RESONANT CAVITY

CROSS-REFERENCE TO CO-PENDING APPLICATIONS

Reference is made to my co-pending applications, Ser. Nos. 534,996 and 534,997 entitled "High Order Beam Mode Resonator" and "Proximity Sensor," respectively which were filed on even date with this application, and which are assigned to the same assignee as this application.

BACKGROUND OF THE INVENTION

The present invention relates to an acoustic beam resonator in which resonant acoustic beam modes are generated. Beam modes are so named because they are mathematically identical to the possible cross-sectional power levels of a laser beam, H. Kogelnik and T. Li, "Laser Beams and Resonators," Applied Optics, 5, 1,550 – 1,567 (Oct., 1966), or the so-called beam waveguide, G. Goubau and F. Schwering, "On the Guided Propagation of Electromagnetic Wave Beams," IRE Trans. on Antennas and Propagation, AP-9, 248 – 256 (May, 1961). The use of a Fabry-Perot structure as a laser resonator, along with its analogous relationship to the beam waveguide for transmission of very short wavelength microwave power, has provided the impetus for developing the electromagnetic theory of its operation. Measurements at microwave frequencies have often been used to verify the theory and analyze the effect of different parameters for a Fabry-Perot resonator.

A Fabry-Perot resonator is basically two mirrors positioned on a common axis and displaced from each other by a distance d. In systems with "large aperture," i.e., when the radial extent of the mirrors is large enough to reflect all but a negligible portion of beam energy, diffraction is neglected and a wave analysis the resonator is carried out as follows.

A component of electric field, $u$, satisfies the scalar wave equation $$\Delta^2 u + k^2 u = 0 \qquad \text{Eq. 1}$$

where $k = (2\pi/\lambda)$ is the propagation constant. Since energy is traveling back and forth in a primarily axial direction solutions of the form $$u = \psi(r, \theta, z)e^{-jkz} \text{ (cylindrical coordinates)}$$

or $$u = \psi(x, y, z)e^{-jkz} \text{ (cartesian coordinates)} \qquad \text{Eq. 2}$$

are substituted into Equation 1 where $e^{-jkz}$ is a plane wave in the $z$ direction and $\psi$ represents the difference between the beam in the cavity and a plane wave.

Although the theory of operation of Fabry-Perot resonator has received considerable attention for electromagnetic waves within both the optical and microwave frequencies, the generation of acoustic resonant beam modes in a Fabry-Perot type of structure has not previously been reported. Acoustic waves, of course, are longitudinal and not transverse as are electromagnetic waves.

SUMMARY OF THE INVENTION

In the present invention, resonant acoustic beam modes are produced. An acoustic energy source produces acoustic wave energy which is reflected by a plurality of reflectors. The acoustic resonates in a predetermined spatial distribution.

DETAILED DESCRIPTION OF THE PREFERRED EMBODIMENTS

In the present invention, it has been discovered that acoustic waves obey the same wave equation and boundary conditions in a Fabry-Perot type resonator and in beam wave-guides as do electromagnetic waves. This is true despite the fact that acoustic waves are longitudinal while electromagnetic waves are transverse.

In this specification, the beam modes generated will be designated as "TEM" modes. Although acoustic waves are longitudinal, and not transverse, they obey the same differential equation and, in this case, satisfy the same boundary conditions as do electromagnetic waves. The mathematical form of the acoustic solution, therefore, is identical to that of the electromagnetic one. The same TEM designation, therefore, is used for the acoustic beam modes. It should be understood that this is not a description of the physical nature of the wave, but rather is the use, for convenience, of designations which are already well known in the laser and microwave resonator art.

Figure 1:
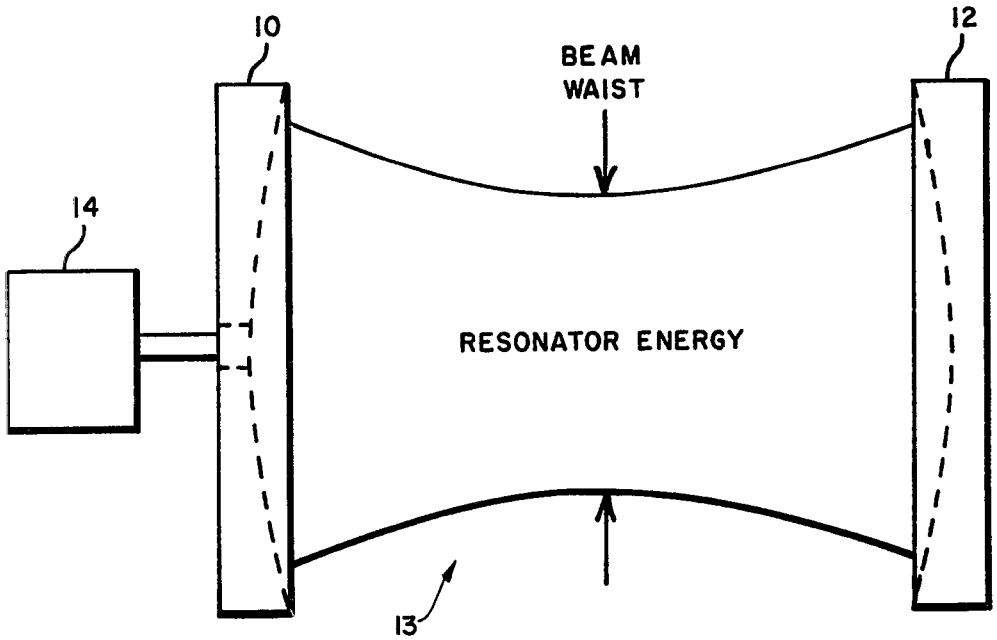
FIG. 1 shows a resonant cavity used to produce acoustic beam modes.

FIG. 1 shows a diagrammatic representation of the present invention. The resonant cavity 13 is formed by reflectors 10 and 12, which are two concave curved surfaces facing one another and separated from one another along an axis. Reflectors 10 and 12 are formed from a material having a high acoustic impedance relative to the medium in which the acoustic waves are propagated (air, water, etc). Acoustic energy source 14 provides energy into the cavity formed by reflectors 10 and 12. As shown in FIG. 1, the acoustic energy may be supplied to the resonant cavity through a hole in one of the reflectors.

The spacing and shape of reflectors 10 and 12 and the wavelength of the energy supplied by energy source 14 determines the particular spatial distribution of the resonant energy within the resonant cavity. The preferred wavelength of the acoustic energy is between about 0.1 mm and about 10 cm. Acoustic energy has an important economic advantage over electromagnetic energy in producing resonant beam modes: a given wavelength can be produced with acoustic waves at a much lower frequency than with electromagnetic waves, due to the lower speed of propagation of acoustic waves. At present, the cost of generating electromagnetic waves shorter than three cm precludes their use in many commercial applications.

As shown in FIG. 1, the reflectors 10 and 12 have curved surfaces. Although plane reflectors can also be used, experiments have shown that reflector alignment becomes very critical, which is a disadvantage for most applications. When spherical surfaces are used, alignment is considerably less critical. The preferred surfaces for reflectors 10 and 12, therefore, are curved. The most preferred surface shape is a spherical surface.

It is known from laser and beam wave guide technology that the axial spacing of two reflectors can be as large as, but not greater than, twice the radius of curvature of the reflectors and stable resonance will still be achieved. It has been found, however, that the beam waist as shown in FIG. 1 becomes very narrow at larger spacing. In certain applications, such as in the proximity sensor described in my co-pending patent application entitled "Proximity Sensor," it is desirable to have the acoustic beam have a rather large beam waist. In this case, it has been found that the preferred ratio R/d of the radius of curvature R and the spacing $d$ is between about 1.5 and about 2.0. Although R/d can range from 0.5 to infinity, less than about 1.5 causes the beam waist to be narrow, and greater than about 2.0 results in a very close spacing of the reflectors.

In general, a resonant cavity resonates in many modes. Each mode is characterized by a certain geometric distribution of energy and a certain resonant frequency, the so-called eigenfunction and eigenvalue, respectively, which comprise a possible solution to the wave equation. In principle, any arbitrary distribution of energy is possible by combining the individual modes in a suitable way. In practice, however, it is difficult to excite the cavity with just the right amount of each mode. For that reason, the preferred embodiments of the present invention generate a single mode of resonance with a desired geometrical shape.

When, as in FIG. 1, the reflectors of the resonant cavity are circular, the distribution of energy between the reflectors can be expressed approximately as $$(2r^2/w^2)^l\ [L_p^l(2r^2/w^2]^2\ (w_0^2/w^2)\ [e^{-2r^2/w^2}]\cos^2 l\phi \qquad \text{Eq. 3}$$

where $r$ is the radius, $\phi$ is the azimuthal angle of the cylindrical coordinate system, $w$ is a length parameter depending on the mirror geometry and axial position between the mirrors, and $w_0$ is the value of w at the beam waist. The integers p and $l$ determine the particular mode, which is denoted as $TEM_pl$. $L_p^l$ is the generalized Laguerre polynomial.

Figure 2A:
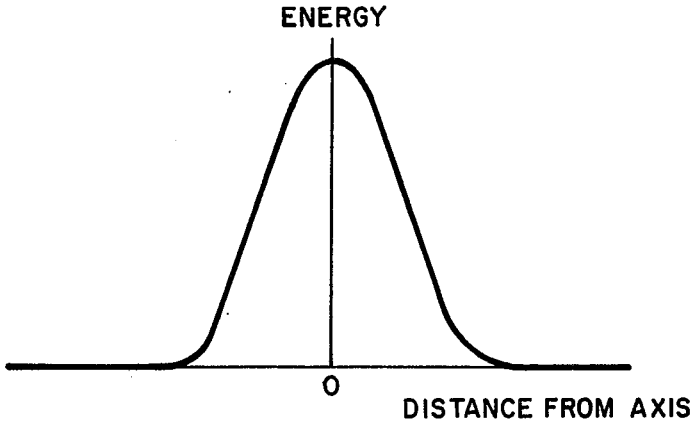
FIGS. 2*a* and 2*b* show the energy distribution at the beam waist for two acoustic beam modes generated by the apparatus of FIG. 1.

In one successful embodiment of the present invention, reflectors 10 and 12 were circular having a diameter of 45 cm and having spherical surfaces with a radius of curvature of 61 cm. The spacing d between the reflectors was 15 to 40 cm. FIG. 2*a* shows the energy distribution at the beam waist for the $TEM_{00}$ mode. This mode was generated with an acoustic wave having a frequency of 6.71 kHz.

Figure 2B:
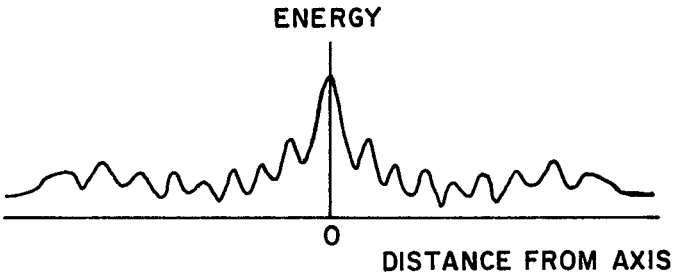

Other acoustic beam modes of the general type shown in FIG. 2*a* have also been generated. In particular, circular $TEM_pl$ modes have been generated where $p$ ranges from 0 to 8 and $l$ is 0. FIG. 2*b* shows the energy distribution of the $TEM_{80}$ mode, which was generated with an acoustic frequency of 9.69 kHz.

Figure 3B:
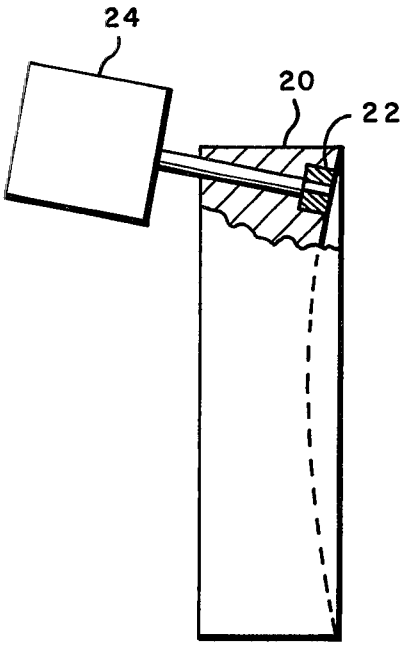
FIG. 3*a* and 3*b* show front and side views, respectively, of a circular reflector for producing cylindrical annular resonant acoustic beam modes.
Figure 3A:
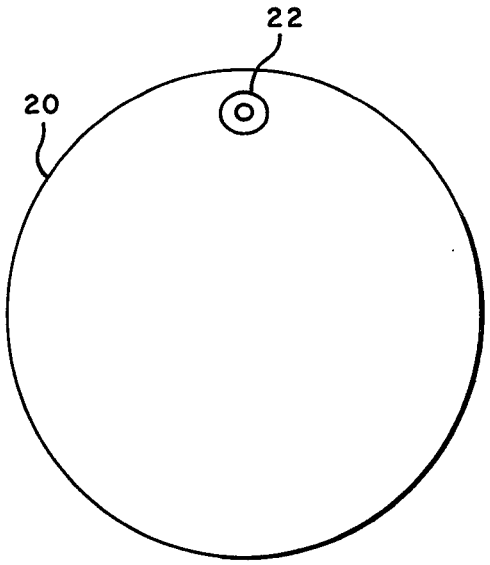

Another resonant energy distribution which has several useful applications is the cylindrical annular distribution. Like the modes described above, this distribution is produced by circular reflectors. FIGS. 3*a* and 3*b* show front and side views of a circular reflector which can be used to generate cylindrical annular resonant modes. Reflector 20 is circular with an essentially spherical surface. Input iris 22 couples energy from acoustic source 24 into the resonant cavity.

It should be noted that input iris 22 is not located at the center of reflector 20, but rather is located near the periphery. The energy is introduced into the resonant cavity, therefore, at a location not on the axis defined by a line connecting the centers of curvature of the two reflectors. It has been found that to generate a cylindrical annular distribution of energy, in which the resonant energy is at a maximum near the periphery of the reflectors and at a minimum (essentially zero) on the axis, the energy must be introduced off-axis. Further description of "off-axis" excitation of high order beam modes is contained in my previously mentioned co-pending patent application entitled "High Order Beam Mode Resonator."

In the case of a cylindrical annular resonant mode, $p$ is 0. In this case Equation 3 is simplified, since $L_0^l = 1$. Equation 3 then becomes $$(2r^2/w^2)^l\ (w_0^2/w^2)\ [e^{-2r^2/w^2}]\cos^2 l\phi \qquad \text{Eq. 4}$$

Figure 4:
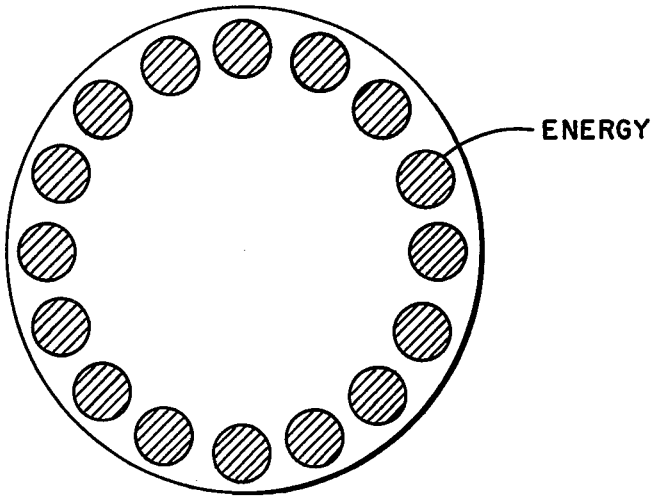
FIG. 4 shows the energy distribution of a resonant cylindrical annular beam mode produced by the apparatus of FIGS. 3*a* and 3*b*.

FIG. 4 shows the energy distribution at the beam waist for the cylindrical $TEM_{08}$ mode. The energy is distributed in $2l$ energy bundles over an annulus whose radius is w( $\sqrt{l}/2$). In proximity sensor applications, therefore, it is advantageous to make $l$ as large as possible. Cylindrical annular acoustic beam modes having $l$ as high as approximately 24 have been successfully produced.

Since the energy in the cylindrical annular mode is confined to an annulus, the entire center portion of the reflector can be removed without affecting the resonance. As described in my co-pending application entitled "Proximity Sensor," a machine tool can be located along the resonator axis without disturbing the resonant condition.

Figure 5B:
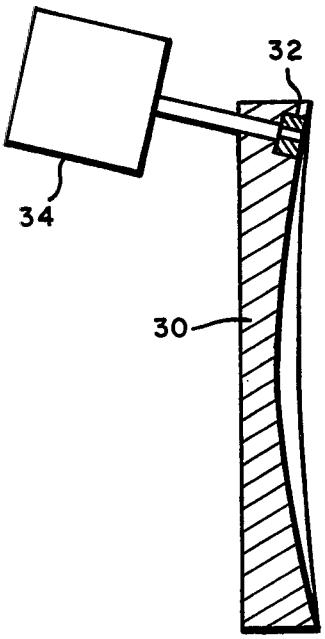
FIGS. 5*a* and 5*b* show front and cross-sectional side views, respectively, of a rectangular reflector for use in one embodiment of the present invention.
Figure 5A:
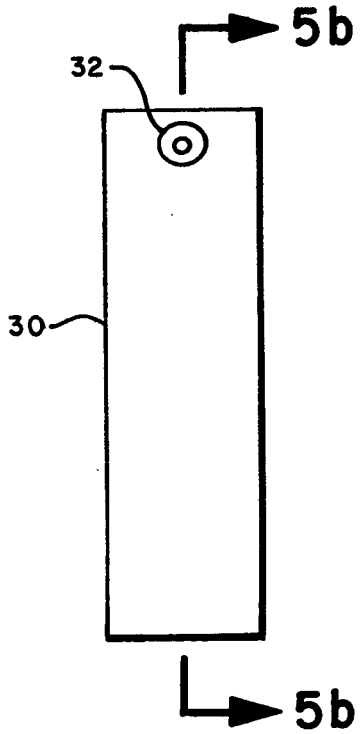

FIGS. 5*a* and 5*b* show front and cross-sectional side views of rectangular shaped relfectors which can be used to produce an essentially planar pattern of resonant acoustic energy. Rectangular reflector 30 includes input coupling iris 32 and energy from acoustic energy source 34 enters the resonant cavity through input coupling iris 32.

When the reflectors are rectangular, the distribution of energy in the midplane of the cavity is approximately.

$$[H_m(x\sqrt{2}/w)]^2\ \ (w_0^2/w^2)\ \ [H_n(y\sqrt{2}/w)]^2\ \ e^{-2(x^2+y^2)/w^2} \qquad \text{Eq. 5}$$

where $x$ and $y$ are rectangular coordinates, $w$ is a length parameter depending on reflector geometry and the axial distance between the reflectors, and $H_n$ and $H_m$ are Hermite polynomials of order $m$ and $n$ respectively. The integers m and n determine the particular mode, which is denoted as $TEM_{mn}$.

One particularly useful mode is the rectangular $TEM_{m0}$ mode. This mode can result in an essentially planar distribution of resonant energy. Equation 5 can be simplified when $n = 0$ since $H_0 = 1$. The resulting energy distribution is described as $$[H_m(x\sqrt{2}/w)]^2 (w_0^2/w^2) e^{-2(x^2+y^2)/w^2} \quad \text{Eq. 6}$$

Figure 6B:
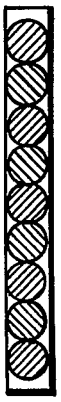
FIGS. 6*a* and 6*b* show the energy distribution of a resonant rectangular acoustic beam mode formed with rectangular reflectors of the type shown in FIGS. 5*a* and 5*b*.
Figure 6A:
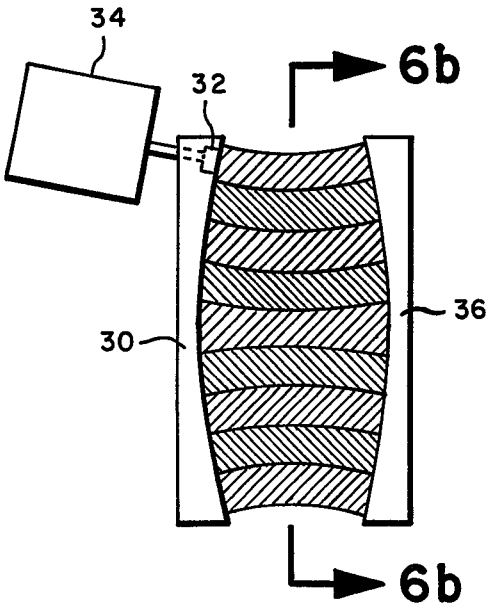

FIG. 6*a* shows the distribution of energy in a resonant cavity formed by rectangular reflectors 30 and 36 for the rectangular $TEM_{80}$ mode. FIG. 6*b* shows the energy distribution at the beam waist. It can be seen that this energy distribution forms essentially a planar curtain of resonant energy. The curtain is formed by a plurality of energy "bundles" which are arranged side by side. The number of energy bundles equals $m + 1$. The term "planar" is used throughout to describe an energy distribution which, in its narrow dimension, is one bundle thick. This is approximately equal to $\sqrt{\lambda d}$, where $\lambda$ is the wavelength and d the reflector spacing.

In conclusion, resonant acoustic beam modes have been generated in a Fabry-Perot type of resonator. A variety of different resonant modes have been generated. Use of these acoustic beam modes has particular application to the field of proximity sensing, as described in my co-pending patent application entitled "Proximity Sensor". The acoustic beam modes have an important advantage over electromagnetic beam modes in the proximity sensing application. A given wavelength can be produced with acoustic waves at a much lower frequency than with electromagnetic waves, due to the lower speed of propagation of acoustic waves.

The present invention has been described with reference to a series of preferred embodiments, it will be understood, however, by workers skilled in the art that changes in form and detail may be made without departing from the spirit and scope of the invention. For example, although the resonant cavities described have had two reflectors, a larger number of reflectors may also be used. When three or more reflectors are used, the apparatus is an acoustic beam waveguide.

The embodiments of the invention in which an exclusive property or right is claimed are defined as follows:

1. Apparatus for producing a resonant acoustic beam, the apparatus comprising:

Fabry-Perot resonant cavity means having concave curved reflectors disposed along an axis; and acoustic energy source means for introducing acoustic energy into the Fabry-Perot resonant cavity means, the acoustic energy resonanting as a beam within the Fabry-Perot resonant cavity.

2. The apparatus of claim 1 wherein the acoustic energy has a wavelength between about 0.1 mm and about 10 cm.

3. Apparatus for producing resonant acoustic beam modes, the apparatus comprising:

first and second reflector means having concave curved surfaces facing one another and separated from one another along an axis, the first and second reflector means forming a beam resonant cavity; and acoustic energy source means for introducing acoustic energy into the beam resonant cavity, the acoustic energy resonating in a predetermined spatial distribution.

4. The apparatus of claim 3 wherein the concave curved surfaces are substantially spherical.

5. The apparatus of claim 3 wherein the acoustic energy source means introduces energy into the beam resonant cavity through an opening in one of the first and second reflector means.

6. The apparatus of claim 3 wherein the first and second reflector means have a high acoustic impedance.

7. The apparatus of claim 3 wherein the acoustic energy has a wavelength between about 0.1 mm and about 10 cm.

8. The apparatus of claim 3 wherein the first and second reflector means are substantially circular.

9. The apparatus of claim 3 wherein the first and second reflector means are substantially rectangular.

10. Apparatus for producing a resonant acoustic beam, the apparatus comprising:

acoustic energy source means for producing acoustic waves; and a plurality of reflectors disposed along a path for reflecting the acoustic waves to form resonant acoustic beam modes, the reflectors having concave curved surfaces and being separated from one another along the path by a distance not greater than twice the radius of curvature of the concave curved surfaces.

11. The apparatus of claim 10 wherein the concave curved surfaces are substantially spherical.

12. The apparatus of claim 10 wherein the reflectors have a high acoustic impedance.

13. The apparatus of claim 10 wherein the acoustic energy has a wavelength between about 0.1 mm and about 10 cm.

* * * * *